US008740326B2

(12) United States Patent
Korogi et al.

(10) Patent No.: US 8,740,326 B2
(45) **Date of Patent: *Jun. 3, 2014**

(54) RECORDING MEDIUM LIFT DETECTION APPARATUS AND INKJET RECORDING APPARATUS

(75) Inventors: Yutaka Korogi, Kanagawa (JP); Takashi Fukui, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 274 days.

This patent is subject to a terminal disclaimer.

(21) Appl. No.: 13/221,555

(22) Filed: Aug. 30, 2011

(65) Prior Publication Data

US 2012/0050373 A1 Mar. 1, 2012

(30) Foreign Application Priority Data

Aug. 31, 2010 (JP) ..... 2010-194378

(51) Int. Cl.
*B41J 25/308* (2006.01)
*B41J 29/38* (2006.01)
*B41J 2/01* (2006.01)

(52) U.S. Cl.
USPC ..... 347/8; 347/16; 347/101

(58) Field of Classification Search
None
See application file for complete search history.

(56) References Cited

U.S. PATENT DOCUMENTS

2003/0197750 A1 10/2003 Iwatsuki et al.
2011/0227985 A1* 9/2011 Korogi ..... 347/16

FOREIGN PATENT DOCUMENTS

| | | | |
|---|---|---|---|
| DE | 199 06 343 | A1 | 9/1999 |
| JP | 10-315553 | A | 12/1998 |
| JP | 2004-299155 | A | 10/2004 |
| JP | 2007-76109 | A | 3/2007 |
| JP | 2007-98650 | A | 4/2007 |
| JP | 2008-126155 | A | 6/2008 |
| JP | 2010-76872 | A | 4/2010 |

OTHER PUBLICATIONS

Japanese Office Action and partial English translation thereof, dated Nov. 19, 2013 for Patent Application No. 2010-194378.

* cited by examiner

*Primary Examiner* — Geoffrey Mruk
(74) *Attorney, Agent, or Firm* — Birch, Stewart, Kolasch & Birch, LLP

(57) ABSTRACT

A recording medium lift detection apparatus for detecting a lift of a recording medium that is conveyed on a predetermined conveyance surface along a predetermined conveyance path, includes: a light projection/receiving, a light projection parallel flat plate, a light projection turning device, a control device and a recording medium lift detection control device.

5 Claims, 9 Drawing Sheets

RECORDING MEDIUM LIFT DETECTION APPARATUS AND INKJET RECORDING APPARATUS

BACKGROUND OF THE INVENTION

1. Field of the Invention

The present invention relates to a recording medium lift detection apparatus and an inkjet recording apparatus. Particularly, the present invention relates to a recording medium lift detection apparatus and an inkjet recording apparatus capable of preventing erroneous detection of a lift of a recording medium.

2. Description of the Related Art

An inkjet recording apparatus ejects liquid droplets from an inkjet head to record an image on a recording surface of a recording medium such as a sheet conveyed through a predetermined conveyance path. When the conveyed recording medium is lifted off a conveyance surface in such an inkjet recording apparatus, the distance (slow distance) between a liquid droplet ejection surface of the inkjet head and the recording surface of the recording medium changes, degrading the recording quality level, or damaging the liquid droplet ejection surface as the recording medium comes into contact with the liquid droplet ejection surface of the head.

Therefore, a recording medium lift detection apparatus is provided in the conveyance path through which the recording medium is conveyed, in order to stop the conveyance of the recording medium when a detected lift of the recording medium is at least a specified value. For example, Japanese Patent Application Publication No. 2010-76872 describes a recording medium lift detection apparatus which is provided with a light projection part and a light receiving part facing each other with a recording medium conveyance path therebetween, wherein the light projection part emits a detection beam toward the light receiving part at a predetermined height position from the conveyance surface and whether the detection beam is received or not is detected.

However, the recording medium lift detection apparatus of Japanese Patent Application Publication No. 2010-76872 which detects the lift of the recording medium based on changes in the amount of light received by the light receiving part when the recording medium blocks the detection beam, often detects erroneously that the recording medium is lifted even when it is not lifted.

The inventors of the present invention had performed keen investigations and found out that such erroneous detection is caused by the change of the amount of light received by the light receiving part. This change of the received amount of light is caused by the fact that air of different temperatures or humidity, or air of different densities, are produced by various devices provided in the inkjet recording apparatus, and this air of different densities flows into the optical path of the detection beam and the detection beam is refracted.

Japanese Patent Application Publication No. 2008-126155 describes an invention that covers an optical axis with an elongated optical axis cover member in order to eliminate such influence of the air of different densities when the detection beam is refracted due to the air of different densities and consequently the optical path of the detection beam is bent as described above.

However, the method of covering the optical axis with the elongated optical axis cover member as described in Japanese Patent Application Publication No. 2008-126155 might cause a recording medium to come into contact with the optical axis cover member when the recording medium is lifted, thereby damaging the recording medium.

Further, even if the recording medium is lifted, the optical axis cover member prevents the recording medium from blocking the optical path, so that the lift of the recording medium cannot be detected. In addition, when adjusting the height of the optical axis in accordance with the thickness of the recording medium, the height of the optical axis cover member needs to be adjusted, which is troublesome. In order to accomplish such a task, a device for changing the height of the optical axis cover member is needed.

SUMMARY OF THE INVENTION

The present invention has been contrived in view of the circumstances described above, and an object of the present invention is to provide a recording medium lift detection apparatus capable of preventing erroneous operations thereof, as well as an inkjet recording apparatus.

An object of the present invention can be accomplished by the following inventions.

In order to attain an object described above, one aspect of the present invention is directed to a recording medium lift detection apparatus for detecting a lift of a recording medium that is conveyed on a predetermined conveyance surface along a predetermined conveyance path, the recording medium lift detection apparatus comprising: a light projection/receiving device which has a light projection unit for emitting a detection beam and a light receiving unit for receiving the detection beam, the light projection unit and the light receiving unit being disposed so as to face each other across the conveyance path; a light projection parallel flat plate, installed on an optical path of the detection beam between the light projection unit and the conveyance path, for causing parallel shift of the optical path of the detection beam; a light projection turning device for turning the light projection parallel flat plate; a control device for controlling the light projection turning device; and a recording medium lift detection control device that monitors an amount of light received by the light receiving unit, and stops conveying the recording medium or outputs an alarm when the amount of light received by the light receiving unit is equal to or lower than a predetermined value, wherein: the light projection/receiving device is installed in such a manner that the detection beam is positioned at a predetermined height above the conveyance surface, the light projection parallel flat plate has a beam entrance surface and a beam emission surface parallel to each other, and is configured to turn about a rotational axis perpendicular to the detection beam, so as to refract the detection beam having entered from the beam entrance surface to cause the parallel shift of the optical path of the detection beam in a direction away from the conveyance surface and emit the detection beam from the beam emission surface, the light projection turning device is connected to the rotational axis of the light projection parallel flat plate, and the control device controls the light projection turning device at predetermined timing so as to turn the light projection parallel flat plate to cause the parallel shift of the detection beam in the direction away from the conveyance surface.

According to this aspect of the invention, even when there is entry of air of different densities, since the detection beam is moved away from the conveyance surface, the detection beam is not affected by the air of different densities, preventing erroneous detection.

Desirably, the recording medium lift detection apparatus further comprises: a light reception parallel flat plate, installed on the optical path of the detection beam between the conveyance path and the light receiving unit, for causing parallel shift of the optical path of the detection beam; a light reception turning device for turning the light reception parallel flat plate; and a light reception aperture that is a stop installed on the optical path of the detection beam between the light reception parallel flat plate and the light receiving unit, wherein: the light reception parallel flat plate has a beam entrance surface and a beam emission surface parallel to each other, and is configured to turn about a rotational axis perpendicular to the detection beam, so as to refract the detection beam having entered from the beam entrance surface to cause the parallel shift of the optical path of the detection beam in a direction to get close to the conveyance surface and emit the detection beam from the beam emission surface, the light reception turning device is connected to the rotational axis of the light reception parallel flat plate, and the control device controls the light projection turning device and the light reception turning device at predetermined timing in such a manner that the light projection parallel flat plate is turned so as cause the parallel shift of the detection beam in the direction away from the conveyance surface and the light reception parallel flat plate is turned so as to cause the parallel shift of the optical path of the detection beam in the direction to get close to the conveyance surface.

According to this aspect of the invention, the disturbance light can be prevented from entering into the light receiving unit, and preventing the entry of the disturbance light into the light receiving unit can prevent an erroneous operation due to the disturbance light and prevent the operations of the recording medium lift detection apparatus from being unstable due to the disturbance light. In addition, with the light receiving parallel flat plate, the distance of the movement of the detection beam can be made greater than the diameter of a light receiving surface of the light receiving unit.

Desirably, the recording medium lift detection apparatus further comprises a light projection aperture that is a stop installed on the optical path of the detection beam, between the light projection unit and the light projection parallel flat plate.

According to this aspect of the invention, part of the light emitted by the light projection part can be prevented from reflecting off the recording medium and becoming the disturbance light.

In order to attain an object described above, another aspect of the present invention is directed to a recording medium lift detection apparatus for detecting a lift of a recording medium that is conveyed on a predetermined conveyance surface along a predetermined conveyance path, the recording medium lift detection apparatus comprising: a light projection/receiving device which has a light projection unit for emitting a detection beam and a light receiving unit for receiving the detection beam, the light projection unit and the light receiving unit being disposed so as to face each other across the conveyance path; and a recording medium lift detection control device that monitors an amount of light received by the light receiving unit, and stops conveying the recording medium or outputs an alarm when the amount of light received by the light receiving unit is equal to or lower than a predetermined value E, wherein: the light projection/receiving device is installed in such a manner that the detection beam is positioned at a predetermined height h above the conveyance surface, and the recording medium lift detection control device neither stops conveying the recording medium nor outputs the alarm during predetermined timing, even when the amount of light received by the light receiving unit becomes equal to or lower than the predetermined value.

According to this aspect of the invention, even when erroneous detection occurs, conveyance of the recording medium is not stopped and the alarm is not output, resulting in preventing erroneous operations and thus erroneous detection.

Desirably, the recording medium lift detection apparatus further comprises: a recessed part formed on the conveyance surface; and a detection plate that is installed in the recessed part and has a first detector which projects from the recessed part and a second detector which projects from the recessed part, the second detector having a smaller projection amount from the recessed part than the first detector, wherein: the projection amount of the first detector from the recessed part is set in such a manner that, when the first detector is positioned at the detection beam and when a height of the detection beam from the conveyance surface is greater than an upper limit of the predetermined height h, the amount of light received by the light receiving unit does not become equal to or lower than the predetermined value E, the projection amount of the second detector from the recessed part is set in such a manner that, when the second detector is positioned at the detection beam and when the height of the detection beam from the conveyance surface is lower than a lower limit of the predetermined height h, the amount of light received by the light receiving unit becomes equal to or lower than the predetermined value E, and the recording medium lift detection control device neither stops conveying the recording medium nor outputs the alarm during the predetermined timing even when the amount of light received by the light receiving unit becomes equal to or lower than the predetermined value.

According to this aspect of the invention, the detection plate is provided, and whether or not the height of the detection beam is within the range of the upper limit to the lower limit can be checked. The conveyance of the recording medium is not stopped and the alarm is not output while the height of the detection beam is checked with the detection plate, and therefore, erroneous operation with the detection plate can be prevented.

In order to attain an object described above, another aspect of the present invention is directed to an inkjet recording apparatus comprising: a conveyance device for conveying a recording medium; an inkjet head for depositing ink droplets onto a recording surface of the recording medium conveyed by the conveyance device so as to render an image on the recording surface; and a recording medium lift detection apparatus as defined above which is installed on an upstream side of the inkjet head and detects the recording medium lifted off the conveyance surface of the conveyance device.

According to this aspect of the invention, an inkjet recording apparatus that does not cause erroneous operations for detecting a lift of a recording medium can be provided.

In order to attain an object described above, another aspect of the present invention is directed to an inkjet recording apparatus comprising: a conveyance device for conveying a recording medium; an inkjet head for depositing ink droplets onto a recording surface of the recording medium conveyed by the conveyance device so as to render an image on the recording surface; and the recording medium lift detection apparatus as defined above which is installed on an upstream side of the inkjet head and detects the recording medium lifted off the conveyance surface of the conveyance device, wherein when the recording medium does not exist on the conveyance surface positioned below the detection beam, the recording medium lift detection control device neither stops conveying the recording medium nor outputs an alarm even when the amount of light received by the light receiving unit becomes equal to or lower than the predetermined value.

According to this aspect of the invention, an inkjet recording apparatus that does not cause erroneous operations for detecting a lift of a recording medium can be provided.

Desirably, the conveyance device is a cylindrical drum that rotates while holding the recording medium on an outer circumferential surface forming the conveyance surface of the conveyance device, so as to convey the recording medium, the inkjet recording apparatus further comprises: a cylindrical recording medium pressing roller that is positioned on an upstream side of the light projection/receiving device and presses the recording medium against the conveyance surface; and at least one recessed part formed on the outer circumferential surface of the drum, and when the at least one recessed part is brought below the recording medium pressing roller by rotation of the drum, the control device controls the light projection turning device in such a manner that the light projection parallel flat plate is turned so as to cause the parallel shift of the detection beam in the direction away from the conveyance surface.

According to this aspect of the invention, when the recessed part is positioned below the recording medium pressing roller, erroneous operations of the recording medium lift detection apparatus caused by the air of different densities flowing around from the recessed part can be prevented.

In order to attain an object described above, another aspect of the present invention is directed to an inkjet recording apparatus comprising: a conveyance device that holds a recording medium on a conveyance surface which is an outer circumferential surface of a cylindrical drum and rotates the drum so as to convey the recording medium; an inkjet head for depositing ink droplets onto a recording surface of the recording medium conveyed by the conveyance device so as to render an image on the recording surface; the recording medium lift detection apparatus as defined in above which is installed on an upstream side of the inkjet head and detects the recording medium lifted off the conveyance surface of the conveyance device; a cylindrical recording medium pressing roller that is positioned on an upstream side of the light projection/receiving device and presses the recording medium against the conveyance surface; and at least one recessed part formed on the outer circumferential surface of the drum, wherein when the at least one recessed part is brought below the recording medium pressing roller by rotation of the drum, the recording medium lift detection control device neither stops conveying the recording medium nor outputs an alarm even when the amount of light received by the light receiving unit becomes equal to or lower than the predetermined value.

According to this aspect of the invention, when the recessed part is positioned under the recording medium pressing roller, the conveyance of the recording medium is not stopped and the alarm is not output even if erroneous detection is carried out due to the influence of the air of different densities flowing around from the recessed part, resulting in preventing erroneous operations and obtaining the equivalent effects to prevention of erroneous detection.

According to a recording medium lift detection apparatus and an inkjet recording apparatus of the present invention, erroneous operations of the recording medium lift detection apparatus can be prevented.

BRIEF DESCRIPTION OF THE DRAWINGS

A preferred embodiment of this invention as well as other objects and benefits thereof; will be explained in the following with reference to the accompanying drawings, in which like reference characters designate the same or similar parts throughout the figures and wherein.

DETAILED DESCRIPTION OF THE PREFERRED EMBODIMENTS

Figure 1:
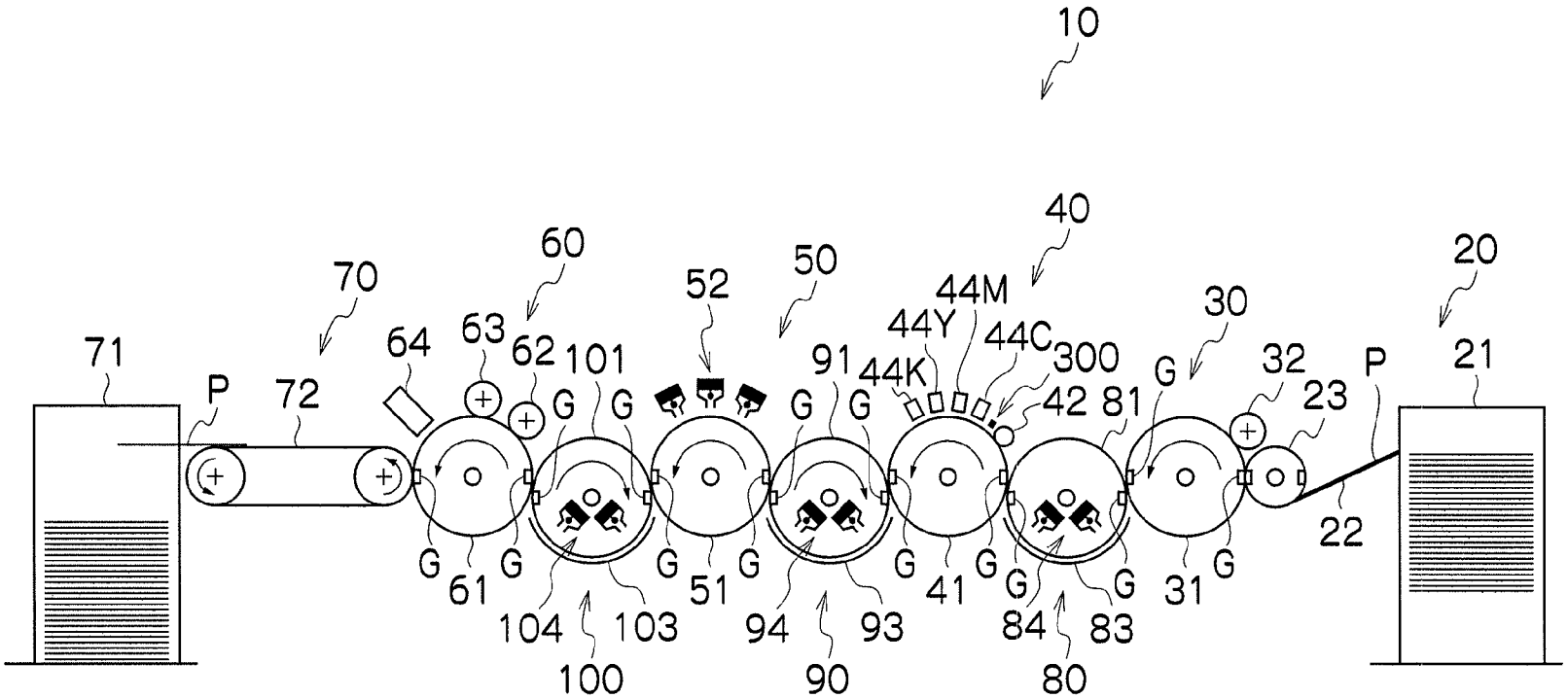
FIG. 1 is a configuration diagram showing the entire configuration of an inkjet recording apparatus according to one embodiment of the present invention.

The parts denoted by the same reference numerals in the diagrams represent the same elements having the same or similar functions. In the present specification, when a range of values is represented as "... to ...," the values of the upper and lower limits are included in the range of values.

Examples in which the present invention is applied to an inkjet recording apparatus are described as embodiments for carrying out the present invention, but the present invention is not limited to these embodiments. The present invention can be applied to any field as long as a lift of a thin plate body held on a drum surface needs to be detected, such as a rotary press apparatus or a film-forming apparatus.

General Configuration of Inkjet Recording Apparatus

One embodiment of an inkjet recording apparatus of the present invention is described with reference to the drawings. FIG. 1 is a configuration diagram showing the entire configuration of an inkjet recording apparatus according to one embodiment of the present invention.

An inkjet recording apparatus 10 shown in FIG. 1 uses ink containing a color material and treatment liquid functioning to aggregate the ink, to form an image on a recording surface each of recording media P based on predetermined image data.

As shown in FIG. 1, the inkjet recording apparatus 10 is configured mainly by a sheet feeding part 20, treatment liquid application part 30, image recording part 40, ink dryer 50, fixing part 60, and recovery part 70.

The sheet feeding part 20 has the recording media P stored therein and supplies the recording media P, one by one, to the treatment liquid application part 30.

The treatment liquid application part 30 applies the treatment liquid to the recording surface of each of the recording media P supplied from the sheet feeding part 20.

The image recording part 40 ejects the ink to the recording surface of the each recording medium P using inkjet heads 44C, 44M, 44Y and 44K, to form an image. In so doing, a recording medium pressing roller 42 presses the recording medium P against an image recording drum 41 to prevent the recording medium P from being lifted off a surface of a cylindrical conveyance drum 41 (the conveyance drum 41 of the image recording part 40 is particularly referred to as "image recording drum 41.")

Figure 2:
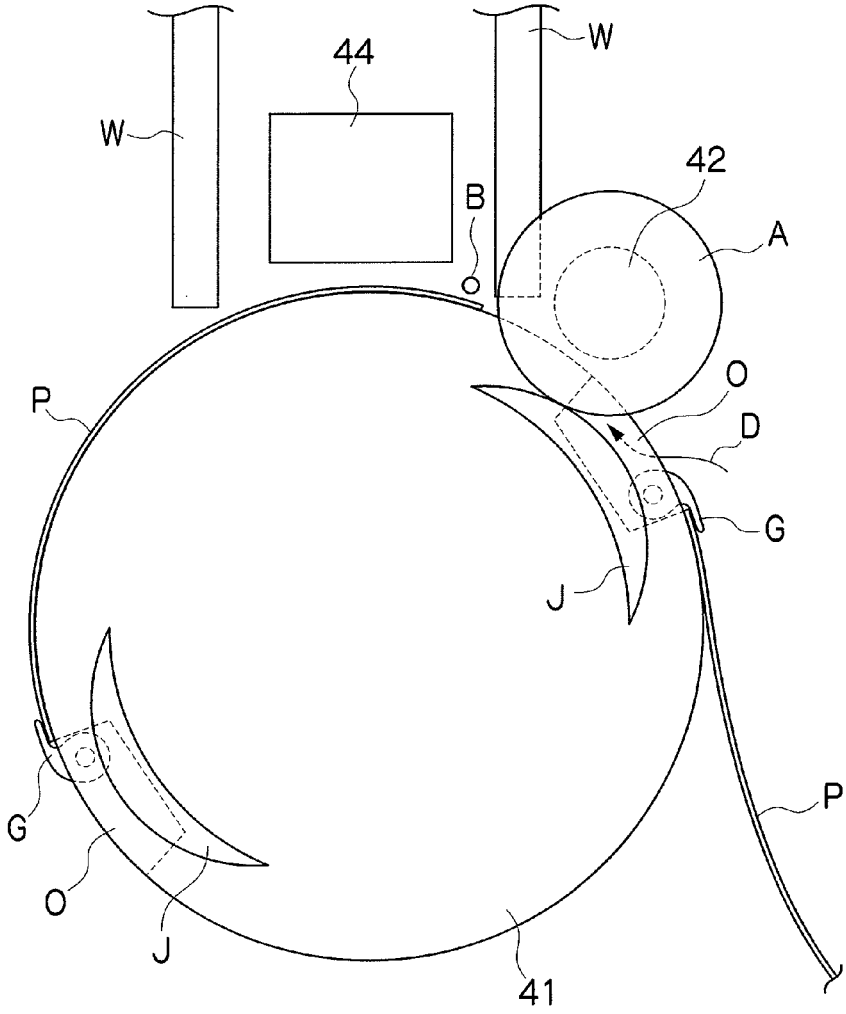
FIG. 2 is a side view of an image recording part 40.
Figure 3:
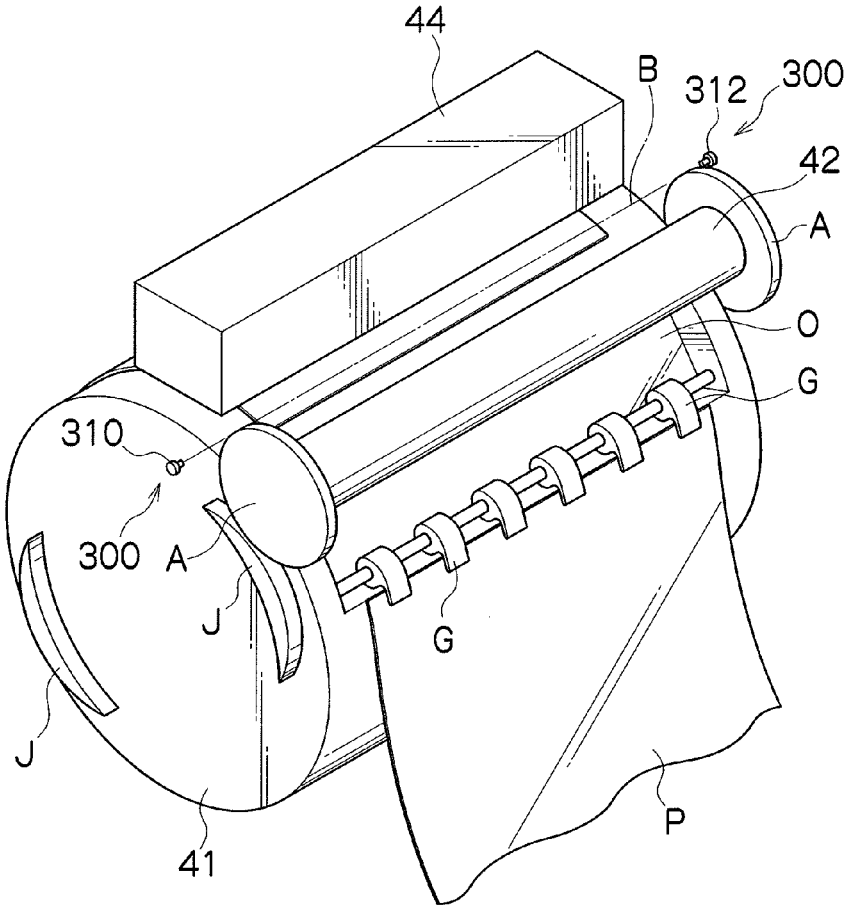
FIG. 3 is a perspective view of the image recording part 40.

Now further description is provided with reference to FIGS. 2 and 3. FIG. 2 is a side view of the image recording part 40. FIG. 3 is a perspective view of the image recording part 40.

As shown in FIGS. 2 and 3, a tip end part of the recording medium P is held between a gripper G and the image recording drum 41. The recording medium P is delivered to the position of the recording medium pressing roller 42 as the recording drum 41 rotates, and is then pressed against the surface of the image recording drum 41 by the recording medium pressing roller 42.

Subsequently, the recording medium P is delivered to the position of the inkjet head 44 (the inkjet heads 44K, 44Y, 44M and 44C are generically called "inkjet head 44"), and the image is formed on the surface of the recording medium P by the inkjet head 44.

At this moment, a recording medium lift detection apparatus 300, located between the recording medium pressing roller 42 and the inkjet head 44, detects whether the recording medium P is lifted off the surface of the image recording drum 41 after passing through the recording medium pressing roller 42.

More specifically, a light projection unit 310 included in the recording medium lift detection apparatus 300 emits a detection beam B to a light receiving unit 312 that is also included in the recording medium lift detection apparatus 300. The light projection unit 310 and the light receiving unit 312 are installed facing each other in the width direction of the image recording drum 41, and the positions where the light projection unit 310 and the light receiving unit 312 are installed are adjusted such that the detection beam B is brought slightly above the surface of the image recording drum 41.

As a result, when the recording medium P is lifted off the surface of the image recording drum 41 and blocks the detection beam B, the amount of light received by the light receiving unit 312 is changed, and the lift of the recording medium P can be detected.

When the recording medium lift detection apparatus 300 detects the lift of the recording medium P as described above, a control apparatus, not shown, stops the rotation of the image recording drum 41.

This can prevent damage to the head surfaces of the inkjet heads 44C, 44M, 44Y and 44K caused by a friction between the lifted recording medium P and the head surfaces.

Here, the recording medium lift detection apparatus 300 is configured such that the position of the detection beam B can move away from the image recording drum 41. The movement distance of the detection beam B can be set at an appropriate value.

The position of the detection beam B is controlled in such a manner that it is caused to separate from the surface of the image recording drum 41 when the recessed part O on the surface of the image recording drum 41 where the gripper G is installed arrives at below the recording medium pressing roller 42 as the image rotating drum 41 rotates (the same meaning is often referred to as "raised," hereinafter).

The detection beam B may be raised when a border between the concave part O and the part of the surface of the image recording drum 41 where the recessed part O is not formed reaches below the recording medium pressing roller 42. The detection beam B may also be raised when the recording medium P does not exist under the detection beam B.

An encoder installed in the image recording drum 41 can monitor what part of an outer circumferential surface of the image recording drum 41 is located under the recording medium pressing roller 42. Based on thus obtained value, the position of the detection beam B can be controlled.

By this means, when the recessed part O reaches below the recording medium pressing roller 42, or when the border between the recessed part O and the part of the surface of the image recording drum 41 where the recessed part O is not formed reaches below the recording medium pressing roller 42, air of different densities flowing from the recessed part O refracts the detection beam B and changes the amount of light received by the light receiving unit 312, and thereby the recording medium lift detection apparatus 300 can avoid erroneously detecting a lift of the recording medium P.

Instead of increasing the height of the detection beam B, the image recording drum 41 may not be subjected to the control, for example, of stopping rotation even when the amount of light received by the light receiving unit 312 varies, when the recording medium P does not exist under the detection beam B. Therefore, even when the air of different densities flowing from the recessed part O refracts the detection beam B and changes the amount of light received by the light receiving unit 312, it is ignored during the absence of the recording medium P under the detection beam B, preventing erroneous detection.

The image recording drum 41 has a jump board J on either end surface thereof. When the rotation of the image recording drum 41 brings the gripper G to the position of the recording medium pressing roller 42, a bearing part A having a larger diameter than the recording medium pressing roller 42 and located on either end of the recording medium pressing roller 42 runs over the jump board J to withdraw the recording medium pressing roller 42 to above the surface of the image recording drum 41, so that the recording medium pressing roller 42 can be prevented from coming into contact with the gripper G.

A wind guard W for keeping the inkjet head 44 out of wind is installed on either side of the inkjet head 44 (see FIG. 2).

The ink dryer 50 evaporates moisture present in the recording medium P.

The fixing part 60 presses and fixes polymer fine particles of the ink into the asperity (uneven surface) of the recording medium P by performing a heating/pressurizing process on the ink on the recording medium P. The recovery part 70 stacks and recovers the recording media P, sent from the fixing part 60, onto a stacker 71.

Configurations and Operations of Recording Medium Lift Detection Apparatus

First Embodiment

Figure 4:
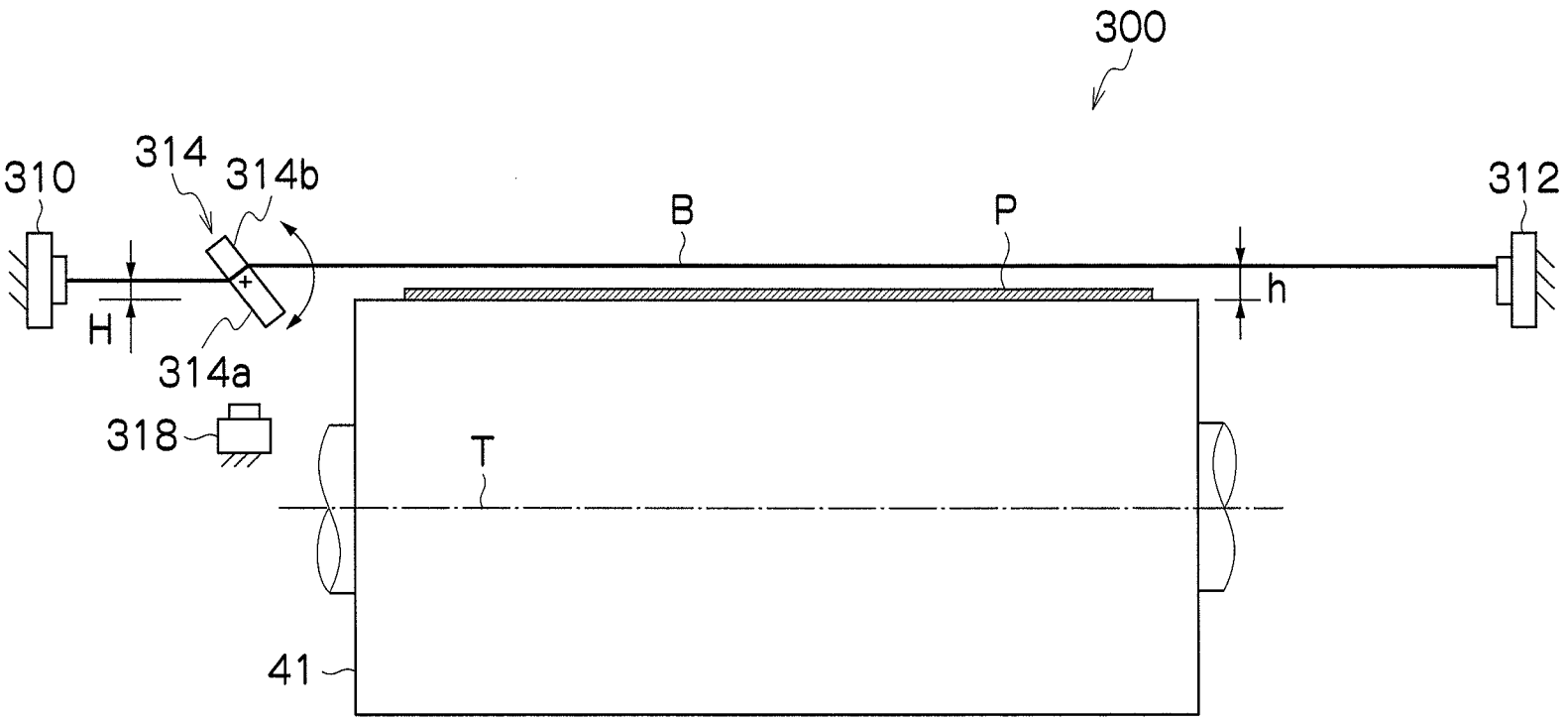
FIG. 4 is a front view of a first embodiment of the present invention.
Figure 5:
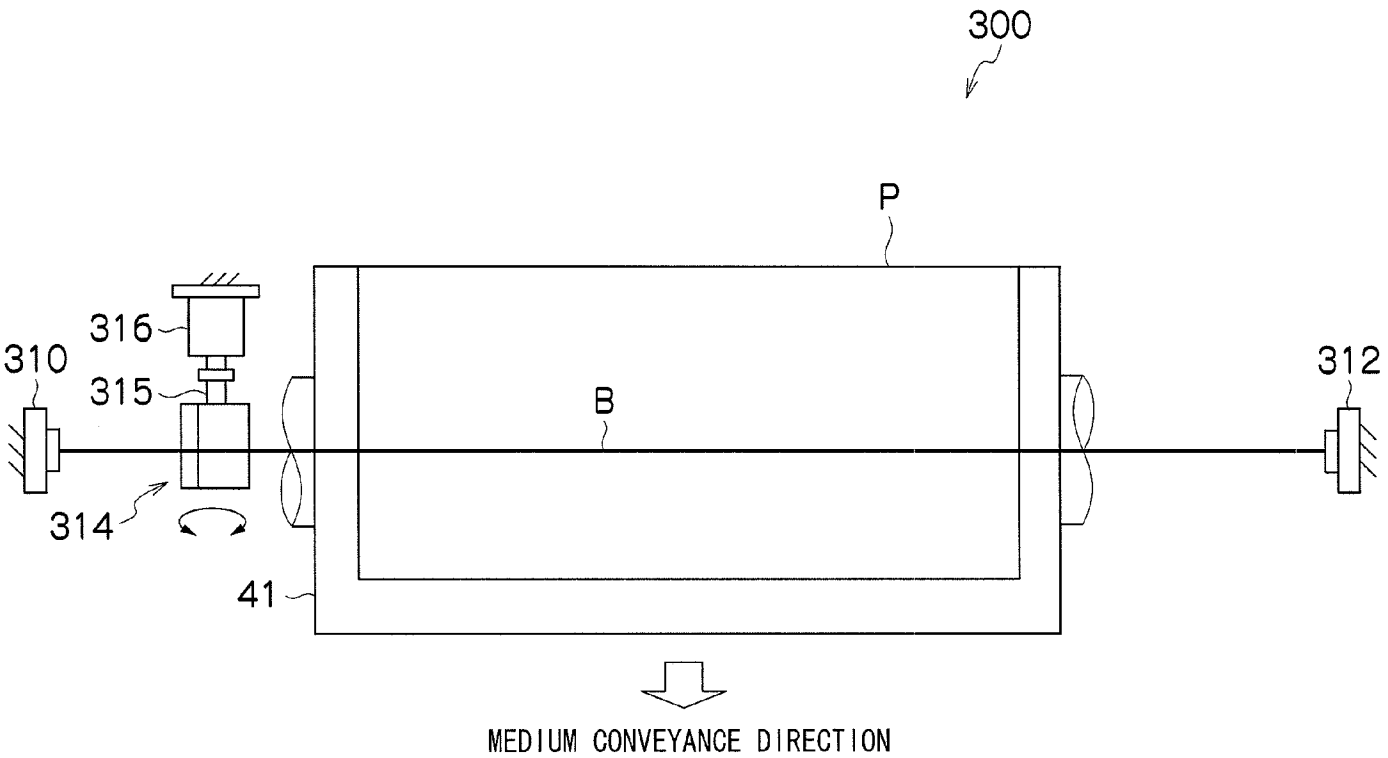
FIG. 5 is a plan view of the first embodiment of the present invention.

Next, the recording medium lift detection apparatus 300 for detecting a lift of the recording medium P is described in further detail with reference to the drawings. A first embodiment of the present invention is described first. FIG. 4 is a front view of the first embodiment of the present invention. FIG. 5 is a plan view of the first embodiment of the present invention.

As shown in FIGS. 4 and 5, the recording medium lift detection apparatus 300 mainly includes: the light projection unit 310 for emitting the detection beam B such as a laser beam; the light receiving unit 312 for receiving the detection beam B emitted from the light projection unit 310; a light projection glass parallel flat plate 314 for changing the height h of the detection beam B (the distance from the surface of the image recording drum 41); a light projection motor 316 for rotating the light projection glass parallel flat plate 314; a light projection starting point position detection sensor 318 for detecting a starting point position of the light projection glass parallel flat plate 314; and the control device for controlling these elements.

The light projection unit 310 and the light receiving unit 312 are disposed facing each other with the image recording drum 41 therebetween in the width direction (longitudinal direction).

The light projection unit 310 is configured by a laser diode (LD) for emitting the laser beam but may be configured by an LED, in place of the LD, to emit LED light. The light projection unit 310 may also adopt other beam emitting devices.

The light receiving unit 312 is configured by a photodiode (PD) but may adopt other light receiving devices.

The positions where the light projection unit 310 and the light receiving unit 312 are installed are adjusted such that the detection beam B is emitted in a direction parallel to a rotational axis T of the image recording drum 41, in other words, is emitted in a direction perpendicular to the conveyance direction of the recording media P, and that the detection beam B is brought to the predetermined height h from the outer circumferential surface (conveyance surface) of the image recording drum 41.

The predetermined height h can be set to approximately 6 mm, so that whether the recording medium P is lifted or not can be detected reliably. The predetermined height h may also be set to an appropriate value according to the thickness of the recording medium P or the like.

When the recording medium P is lifted and blocks the detection beam B, the amount of light received by the light receiving unit 312 changes. The control apparatus (also referred to as "system controller"), not shown, monitors the change in the amount of light received. When the amount of change or the change in the amount of light received reaches a predetermined value or a value within a predetermined range, it is determined that the recording medium P is lifted, and then the control apparatus performs control in such a manner that the rotation of the image recording drum 41 is stopped or an alarm is output.

The light projection glass parallel flat plate 314 is configured by, for example, a rectangular transparent glass plate that has a beam entrance surface 314*a* and a beam emission surface 314*b* that are parallel to each other. The light projection glass parallel flat plate 314 may be made of plastic or other materials instead of glass. The shape thereof may not only be a rectangular shape but also round or other shapes. The light projection glass parallel flat plate 314 is disposed between the light projection unit 310 and the light receiving unit 312 and closer to the light projection unit 310 than the image recording drum 41 so as to intersect the detection beam B.

In addition, the light projection glass parallel flat plate 314 is configured so as to be able to rotate around a rotational axis 315 provided on a side surface on a downstream side of the conveyance direction of the recording media P. The light projection glass parallel flat plate 314 is driven and turned by the light projection motor 316 connected to the rotational axis 315.

The detection beam B emitted from the light projection unit 310 enters the light projection glass parallel flat plate 314. When the beam entrance surface 314*a* of the light projection glass parallel flat plate 314 is perpendicular to the detection beam B, the detection beam B is emitted with no change from the beam emission surface 314*b* and received by the light receiving unit 312.

When, on the other hand, the beam entrance surface 314*a* of the light projection glass parallel flat plate 314 is inclined at an angle that is not perpendicular to the detection beam B, the detection beam B is refracted in the light projection glass parallel flat plate 314 such that the optical axis thereof is shifted upward (away from the outer circumferential surface of the image recording drum 41) or downward (toward the outer circumferential surface of the image recording drum 41), and emitted from the beam emission surface 314*b* and received by the light receiving unit 312.

In other words, the distance h between the image recording drum 41 and the detection beam B can be adjusted by turning the light projection glass parallel flat plate 314 by means of the light projection motor 316 in such a manner that the incidence angle of the detection beam B emitted from the light projection unit 310 is adjusted for entering the beam entrance surface 314*a* of the light projection parallel flat plate 314.

Figure 6:
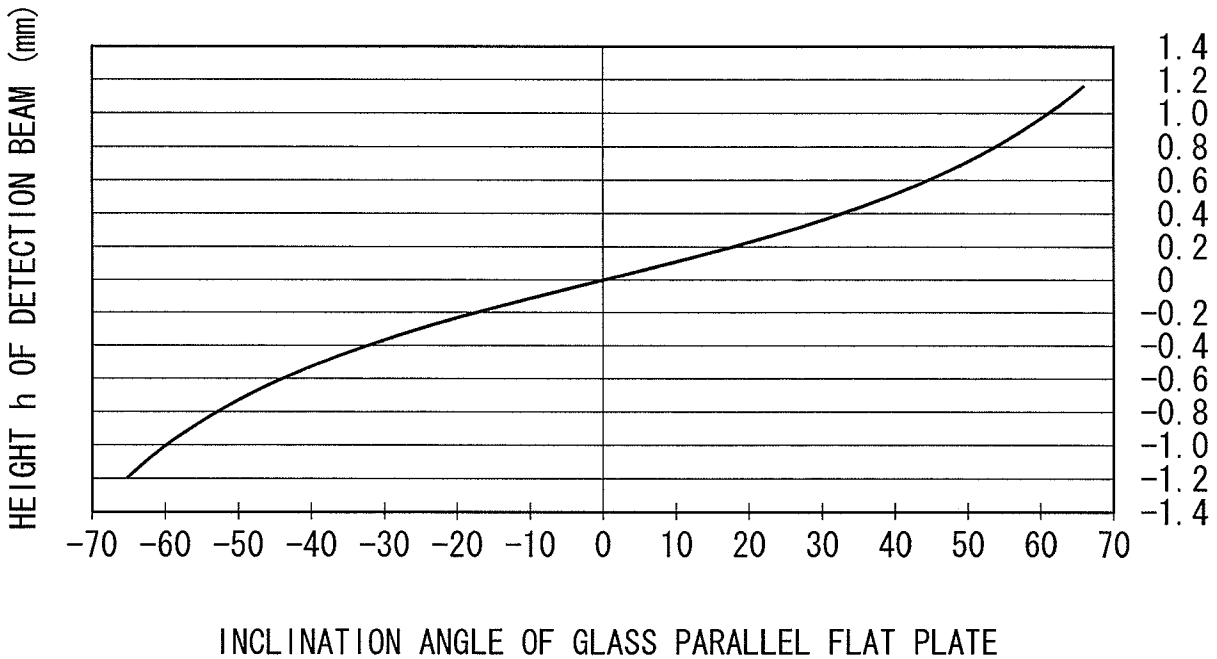
FIG. 6 is a graph showing a relationship between a turning angle (inclination angle) of a light projection glass parallel flat plate and a displacement X (mm) of a detection beam B in a height direction.

Further description is provided with reference to FIG. 6. FIG. 6 is a graph showing a relationship between a turning angle (inclination angle) of the light projection glass parallel flat plate 314 and a displacement X (mm) of the detection beam B in the height direction.

According to this graph, when the detection beam B enters the light projection glass parallel flat plate 314 from the left, the angle at which the beam entrance surface 314*a* of the light projection glass parallel flat plate 314 is perpendicular to the detection beam B is represented as 0°, the turning angle in a counterclockwise direction is expressed as a positive (+) value, and the turning angle in a clockwise direction is expressed as a negative (−) value.

As shown in FIG. 6, the height h of the detection beam B fluctuates in a vertical direction, depending on the turning angle (inclination angle) of the light projection glass parallel flat plate 314. As shown in FIG. 6, the height h can be finely adjusted with high resolution and a high degree of accuracy in accordance with the inclination angle. In this manner, an optical path of the detection beam B can be moved parallel as the light projection glass parallel flat plate 314 turns.

As illustrated in FIGS. 4 and 5, the inclination angle is adjusted by the light projection motor 316 controlled by the control apparatus, not shown. A positively/negatively rotatable pulse motor can be adopted as the light projection motor 316. The light projection motor 316 is not necessarily a motor, but it can be a general device capable of turning.

The light projection motor 316 and the light projection glass parallel flat plate 314 are connected to each other by the rotational axis 315. The turning motion of the light projection motor 316 is controlled by the control apparatus (not illustrated) in such a manner that the angle of the light projection glass parallel flat plate 314 becomes a predetermined inclination angle at predetermining timing.

The timing to control the inclination angle of the light projection glass parallel flat plate 314 is now described with reference to FIGS. 2 and 4.

The air that exists in the vicinity of the outer circumferential surface of the image recording drum 41 has substantially constant density because the temperature of the image recording drum 41 is adjusted.

In the inkjet recording apparatus 10, however, various devices are provided the inkjet recording apparatus 10, and therefore there is air having various temperatures and humidity, that is, air of various densities due to effects of such various devices (the air of various densities, which is air having different density than the air near the outer circumferential surface of the image recording drum 41, is referred to as air D of different densities).

When the recessed part O formed on the outer circumferential surface of the image recording drum 41 is not positioned under the recording medium pressing roller 42, the recording medium pressing roller 42 blocks the air D of different densities, and thus the detection beam B that exists in the downstream of the conveyance direction of the recording medium P from the recording medium pressing roller 42 propagates through the air having substantially constant density and thus is not affected by the air D of different densities.

However, when the recessed part O is positioned below the recording medium pressing roller 42 as the image recording drum 41 rotates, especially when the border between the recessed part O and the part that does not have the recessed part O (simply referred to as "border with the recessed part O") is positioned below the recording medium pressing roller 42, the air D of different densities that flows from the recessed part O enters the optical path of the detection beam B and refracts the detection beam B to change the amount of light received by the light receiving unit 312. This causes an erroneous operation in which the recording medium P is detected as being lifted, although the recording medium P is not lifted.

As a result of the keen investigations, the inventors has found out that the entry of the air D of different densities has an influence on a small range from the surface of the image recording drum 41 and that the greater the range from the surface of the image recording drum 41, the lower the temperature/humidity gradient of the air.

In other words, the inventors has found out that erroneous operations caused by the recording medium lift detection apparatus 300 due to the entry of the air D of different densities can be prevented by moving the optical path of the detection beam B to a position slightly away from the surface of the image recording drum 41.

Therefore, in the recording medium lift detection apparatus 300 of the present embodiment, when the recessed part O of the image recording drum 41 or the border with the recessed part O is positioned below the recording medium pressing roller 42, the control apparatus, not shown, controls the light projection motor 316, thereby changing the inclination angle of the light projection glass parallel flat plate 314 so as to increase the height h of the detection beam B.

The height h that is changed as described above is determined based on the thickness of the light projection glass parallel flat plate 314, the refraction index, and the incidence angle. When the inclination angle of the light projection glass parallel flat plate 314 exceeds a certain range, the detection beam B is reflected completely, significantly reducing the amount of transmitted light. For example, when the glass thickness is 2.3 mm and the glass refraction index is 1.46, the limit of the rotation angle is plus or minus 60 degrees (±60 degrees), and the height can be changed by plus or minus 1.2 mm (±1.2 mm).

In order to increase the variable amount, it is required to increase the thickness of the parallel flat plate glass or to use glass with high refraction index.

Increasing the height of the detection beam B by an operation can avoid the impact of the air D of different densities. By appropriately adjusting the movement height of the detection beam B, not only is it possible to avoid the impact of the air D of different densities, but also the speed of the operation of the recording medium lift detection apparatus can be increased because the inclination angle of the light projection glass parallel flat plate 314 is not changed too significantly.

Here, the fact that the recessed part O or the border with the recessed part O is positioned below the recording medium pressing roller 42 can be read from a signal of an encoder (not shown) installed in the image recording drum 41. The control apparatus, not shown, can monitor the signal of the encoder (not shown) and can adjust the height of the detection beam B at appropriate timing.

In FIGS. 4 and 5, the light projection starting point position detection sensor 318 is configured by, for example, a proximity sensor (magnetic sensor or the like) and detects that the light projection glass parallel flat plate 314 is positioned in a starting point position.

This detection is performed by detecting a detected element, not shown, which is installed in a lower surface part of the light projection glass parallel flat plate 314. An output from the light projection starting point position detection sensor 318 is transmitted to the control apparatus, not shown, and used for the starting position adjustment and the like.

Note that the light projection starting point position detection sensor 318 can be configured by adopting a contact sensor.

Second Embodiment

Figure 7:
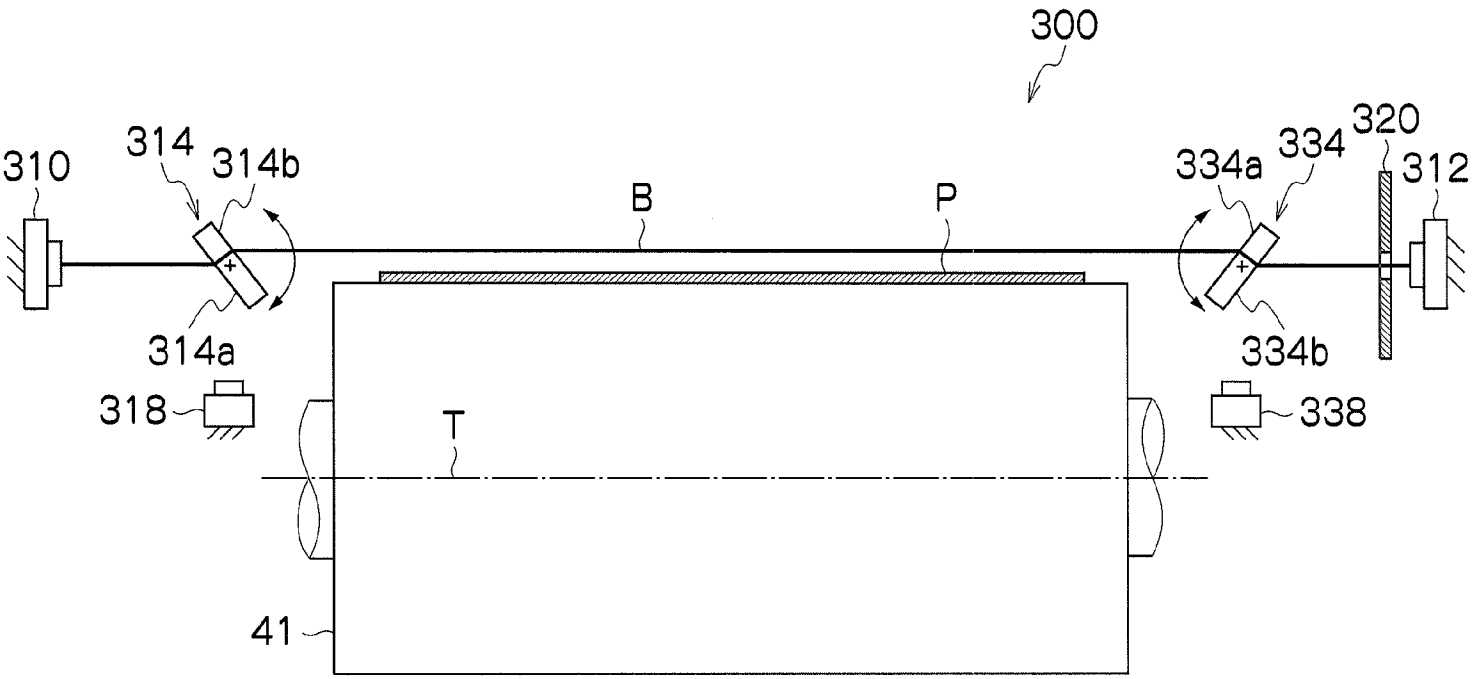
FIG. 7 is a front view of a second embodiment of the present invention.

A second embodiment of the present invention is described with reference to the drawings. FIG. 7 is a front view of the second embodiment of the present invention. Since the second embodiment of the present invention is almost the same as the first embodiment, thus the differences therebetween are described and the descriptions of the same parts are omitted.

In addition to the first embodiment, the second embodiment of the present invention has a light reception glass parallel flat plate 334 installed on the light receiving side, a light reception aperture 320 which is installed on the light receiving side and serves as a stop, and a light reception starting point position detection sensor 338. Although not shown, the second embodiment also has a light reception motor for turning the light reception glass parallel flat plate 334. The light reception motor is not necessarily a motor but it can be a general device capable of turning.

As with the light projection glass parallel flat plate 314, the light reception glass parallel flat plate 334 is configured by, for example, a rectangular transparent glass plate that has a beam entrance surface 334*a* and a beam emission surface 334*b* that are parallel to each other. The light reception glass parallel flat plate 334 is disposed between the light projection unit 310 and the light receiving unit 312 and closer to the light reception unit 312 than the image recording drum 41 so as to intersect the detection beam B. The shape of the light reception glass parallel flat plate 334 may not only be a rectangular shape but also round or other shapes.

Moreover, as with the light projection glass parallel flat plate 314, the light reception glass parallel flat plate 334 has a rotational axis. The light reception glass parallel flat plate 334 is connected to the light reception motor by means of this rotational axis so as to be rotatable around the rotational axis.

The light reception glass parallel flat plate 334 serves functions opposite to those of the light projection glass parallel flat plate 314. In other words, when the light projection glass parallel flat plate 314 moves parallel the detection beam B away from the surface of the image recording drum 41, the light reception glass parallel flat plate 334 moves parallel the detection beam B, which has been moved parallel away from the surface of the image recording drum 41, close to the surface of the image recording drum 41.

Specifically, the control apparatus, not shown, performs control at predetermined timing in such a manner that the angles of the light projection glass parallel flat plate 314 and the light reception glass parallel flat plate 334 become predetermined inclination angles simultaneously. As a result, the detection beam B is moved parallel away from the surface of the image recording drum 41 (so that the height h increases) by the light projection glass parallel flat plate 314 and flies above the outer circumferential surface of the image recording drum 41, and is moved parallel close to the image recording drum 41 (so that the height h decreases) by the light reception glass parallel flat plate 334 and received by the light receiving unit 312 through the light reception aperture 320.

The basic functions and basic operations of the light reception glass parallel flat plate 334 and the light reception starting point position detection sensor 338 are same as those of the light projection glass parallel flat plate 314 and the light projection starting point position detection sensor 318, thus the descriptions thereof are omitted.

By providing the light reception glass parallel flat plate 334 in this way, the distance by which the detection beam B is shifted (change in the distance between the detection beam B and the outer circumferential surface of the image recording drum 41) can be made greater than the diameter of the light receiving surface of the light receiving unit 312.

In other words, with the light projection glass parallel flat plate 314 alone, the detection beam B is shifted only in a range where the detection beam B does not spread out from the light receiving surface of a light receiving element used in the light receiving unit 312. However, by providing the light reception glass parallel flat plate 334, the detection beam B can be shifted oppositely into the light receiving surface of the light receiving element by the light reception glass parallel flat plate 334 even when the light projection glass parallel flat plate 314 shifts the detection beam B widely, and therefore the amount of shift can be increased.

The light reception aperture 320 is installed between the light receiving unit 312 and the light reception glass parallel flat plate 334. The light reception aperture 320 can prevent the light receiving unit 312 from receiving disturbance light other than the detection beam B.

As a result, erroneous operations of the recording medium lift detection apparatus 300 caused by disturbances can be prevented. The disturbance light includes, of the beam emitted from the light projection unit 310, light spreading and being reflected by the recording medium P or other parts, as well as direct light and diffuse reflection light from a light source other than the light projection unit 310.

Third Embodiment

Figure 8:
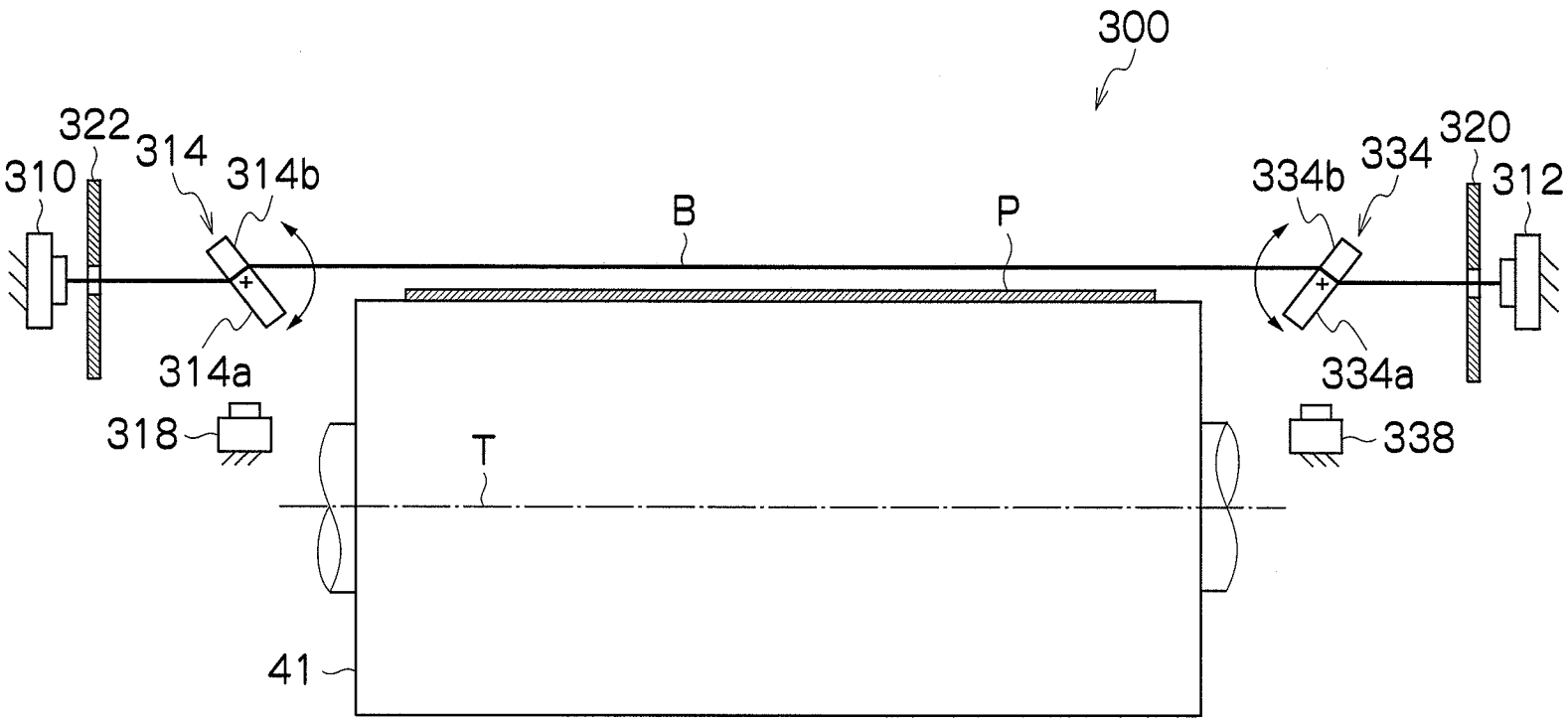
FIG. 8 is a front view of a third embodiment of the present invention.

Next, a third embodiment of the present invention is described with reference to the drawings. FIG. 8 is a front view of the third embodiment of the present invention. Since the third embodiment of the present invention is almost the same as the second embodiment, thus the differences therebetween are described and the descriptions of the same parts are omitted.

In addition to the second embodiment, the third embodiment of the present invention has a light projection aperture 322 installed on the light projection side also. The light projection aperture 322 is installed between the light projection unit 310 and the light projection glass parallel flat plate 314.

This can converge (channel) the detection beam B emitted from the light projection unit 310 and prevent the emission of light spreading which can be disturbances, or light reflected by the recording medium P and received by the light receiving unit 312. As a result, erroneous operations of the recording medium lift detection apparatus 300 can be prevented more effectively.

Fourth Embodiment

Figure 9:
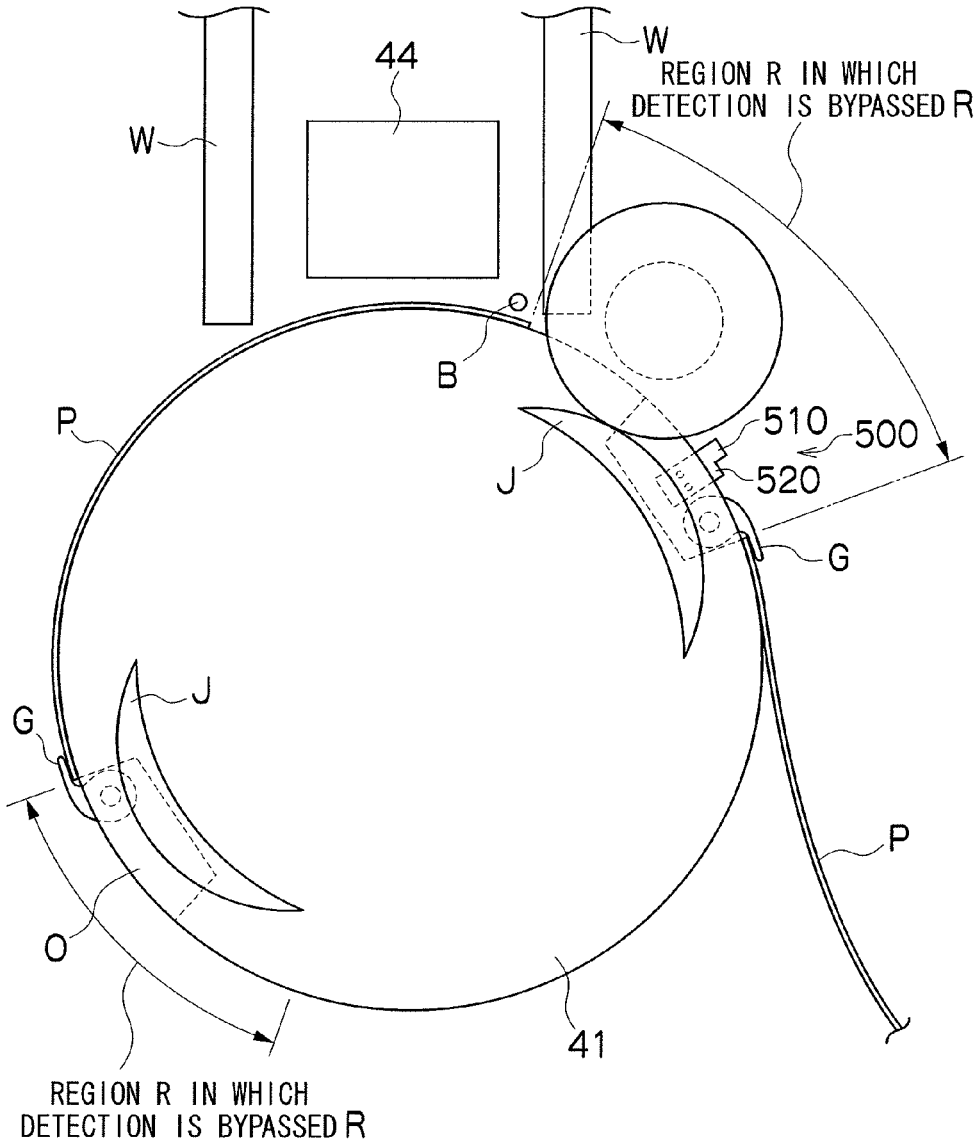
FIG. 9 is a side view of an image recording part.

A fourth embodiment of the present invention is described next with reference to the drawings. FIG. 9 is a side view of the image recording part 40. In FIG. 9, the parts denoted by the same reference numerals as those of FIG. 2 are identical to the parts shown in FIG. 2, thus the descriptions thereof are omitted.

Unlike the first to third embodiments, in the fourth embodiment of the present invention, the position of the detection beam B is not shifted. When the recording medium P does not exist below the detection beam B (one closer to the detection beam B, of two parts where a flat surface including the detection beam B and the rotational axis T of the image recording drum 41 intersects with the outer circumferential surface of the image recording drum 41), even if the light receiving unit 312 detects a change in the amount of the detection beam B received and this amount becomes equal to or lower than a predetermined value, the control apparatus (not shown) does not carry out the operation which is to be performed when a lift of the recording medium P is detected, such as stopping the rotation of the image recording drum 41 or outputting the alarm. In other words, when the recording medium does not exist below the detection beam B, and even when the control apparatus, not shown, receives from the light receiving unit 312 a signal indicating that the amount of light received is equal to or lower than the predetermined value, the control apparatus bypasses (ignores) this signal and performs control that does not support the operation performed when detecting a lift of the recording medium P.

With reference to FIG. 9, when a region R where detection is not performed (a region where the recording medium P does not exist) is located below the detection beam B as a result of the rotation of the image recording drum 41, even if a signal received from the light receiving unit 312 which indicates that the amount of light received is equal to or lower than the predetermined value is received, this signal is bypassed and the control is performed in such a manner that the operation which is to be carried out when a lift of the recording medium P is detected is not carried out.

This can prevent the occurrence of erroneous detection. In other words, when the recording medium P does not exist below the detection beam B (when the region R where the detection is bypassed exists below the detection beam B), the recording medium cannot block the detection beam B. Therefore, even when the amount of light received by the light receiving unit 312 is equal to or lower than the predetermined value, this means that the detection is performed erroneously. Thus, bypassing this error can prevent the stoppage of the image recording drum 41 or the output of the alarm caused by erroneous detection.

Alternatively, when the recessed part O or the border with the recessed part O of the image recording drum 41 is positioned below the recording medium pressing roller 42, the control apparatus, not shown, bypasses a signal from the light receiving unit 312 which indicates that the amount of light received is equal to or lower than the predetermined value even if receiving the signal, and performs control so as not to support the operation performed when detecting a lift of the recording medium P.

This can prevent the recording medium lift detection apparatus from erroneously detecting that the recording medium P is lifted, although the recording medium P is not actually lifted even if the detection beam B is refracted and the amount of light received by the light receiving unit 312 is changed by allowing the air D of different densities to enter the optical path of the detection beam B from the recessed part O when the rotation of the image recording drum 41 places the recessed part O below the recording medium pressing roller 42 or especially when the border between the recessed part O and non-concave part is positioned below the recording medium pressing roller 42.

As shown in FIG. 9, the fourth embodiment of the present invention has a detection plate 500. The detection plate 500 is a rectangular-like flat plate including a first detector 510 which is a tip end part including one of the sides of the detection plate and partially projecting, a second detector 520 that is a part not projecting in the tip end part, and a body part other than the first detector 510 and the second detector 520.

The detection plate 500 is installed in the recessed part O of the image recording drum 41, wherein the first detector 510 and the second detector 520 project from the recessed part O by a predetermined length.

The length of the part of the first detector 510 projecting from the recessed part O is set to the upper limit of a predetermined value of the height of the detection beam B from the surface of the image recording drum 41 (simply referred to as "height of the detection beam B"). In other words, the length of the projecting part of the first detector 510 is set to a brink (borderline) projecting amount such that when the actual height of the detection beam B is greater than the predetermined value (the value that is set beforehand as the height of the detection beam B), the first detector 510 does not block the detection beam B even if the first detector 510 is brought to the position of the detection beam B by the rotation of the image recording drum 41.

The length of the projecting part of the second detector 520 from the recessed part O is set to the lower limit of a predetermined value of the height of the detection beam B. In other words, the length of the projecting part of the second detector 520 is set to a brink (borderline) projecting amount such that when the actual height of the detection beam B is lower than the predetermined value (the value that is set beforehand as the height of the detection beam B), the second detector 520 blocks the detection beam B when the second detector 520 is brought to the position of the detection beam B by the rotation of the image recording drum 41.

As a result, whether the actual height of the detection beam B falls within an allowable range as the predetermined value or not can be determined. In other words, the control apparatus, not shown, can recognize whether the first detector 510 is brought to the position of the detection beam B, by reading the rotational angle of the image recording drum 41 using the encoder installed in the image recording drum 41 (simply referred to as an "encoder"). In so doing, when the control apparatus, not shown, does not receive from the light receiving unit 312 a signal indicating that the detection beam B is blocked, the control apparatus can determine that the height of the detection beam B is greater than the predetermined value.

The control apparatus, not shown, can also recognize that the second detector 520 exists in the position of the detection beam B, by reading the rotational angle of the image recording drum 41 by means of the encoder. In so doing, when the control apparatus, not shown, receives from the light receiving unit 312 the signal indicating that the detection beam B is blocked, the control apparatus can determine that the height of the detection beam B is lower than the predetermined value.

Even when the detection plate 500 passes through the position of the detection beam B, if the control apparatus, not shown, does not determine that the height of the detection beam B is greater than the predetermined value and does not determine that the height of the detection beam B is lower than the predetermined value, it is determined that the height of the detection beam B is equal to the predetermined value.

In this case, even when the detection beam B is blocked by the detection plate 500, blocking the detection beam B neither stops the rotation of the image recording drum 41 nor outputs the alarm, since the detection plate 500 is installed in the region R where the detection is not bypassed.

In addition, although the diagram illustrates the detection plate 500 provided only in one of the two recessed parts of the image recording drum 41, but the detection plate 500 may be provided in each of the two concave parts.

Further, according to an apparatus including the configurations described in the first to third embodiments, when the height of the detection beam B is outside the predetermined value, turning the glass parallel flat plates can adjust the height of the detection beam B to predetermined height.

Needless to say, a recording medium lift detection apparatus according to the present invention can be applied to not only a system for conveying a recording medium while holding the recording medium on the outer circumferential surface of a drum, but also a system for conveying a recording medium or a plate-like matter while placing the recording medium or plate-like matter on a belt, and general conveyance systems used for conveying other recording media and plate-like matters.

Detailed Configurations of Inkjet Recording Apparatus

Next, of the configurations of the inkjet recording apparatus 10, the configurations of the parts other than the recording medium lift detection apparatus 300 are described in detail with reference to the drawings.

The inkjet recording apparatus 10 shown in FIG. 1 is a recording apparatus that uses water-based ink (ink that has water in its solvent) to record an image on a sheet of recording medium P by means of an inkjet system. The inkjet recording apparatus 10 includes the sheet feeding part 20 for feeding a recording medium P, the treatment liquid application part 30 for applying a predetermined treatment liquid to a recording surface of the recording medium P, the image recording part 40 for causing inkjet heads to deposit ink droplets of cyan (C), magenta (M), yellow (Y) and black (K) onto the recording surface of the recording medium P to render a color image, the ink dryer 50 for drying the ink droplets deposited on the recording medium P, the fixing part 60 for fixing the image recorded on the recording medium P, and the recovery part 70 for recovering the recording medium P.

The treatment liquid application part 30, the image recording part 40, the ink dryer 50 and the fixing part 60 are provided with conveyance drums 31, 41, 51 and 61, respectively, as conveyance devices for conveying the recording medium P. The recording medium P is conveyed by the conveyance drums 31, 41, 51 and 61 through the treatment liquid application part 30, the image recording part 40, the ink dryer 50 and the fixing part 60 respectively.

Each of the conveyance drums 31, 41, 51 and 61 is formed in accordance with the width of the recording medium and driven to rotate (in the counterclockwise direction in FIG. 1) by a motor, not shown. A circumferential surface of each of the conveyance drums 31, 41, 51 and 61 is provided with the grippers G. The recording medium P is held at its tip end part by the grippers G and conveyed. In this embodiment, two grippers G are provided on a circumferential surface of each of the conveyance drums 31, 41, 51 and 61 (with a 180-degree interval therebetween), so that two recording media can be conveyed per rotation of the conveyance drums.

A plurality of suction hole are formed on the circumferential surface of each of the conveyance drums 31, 41, 51 and 61. The rear surface of the recording medium P is vacuum-suctioned by the suction holes and held on the outer circumferential surfaces of the conveyance drums 31, 41, 51 and 61. Note in this embodiment that the recording medium P is vacuum-suctioned and held on the outer circumferential surfaces of the conveyance drums 31, 41, 51 and 61, but the recording medium P may be electrostatically suctioned and held on the outer circumferential surfaces of the conveyance drums 31, 41, 51 and 61.

Delivery cylinders 80, 90 and 100 are disposed between the treatment liquid application part 30 and the image recording part 40, between the image recording part 40 and the ink dryer 50, and between the ink dryer 50 and the fixing part 60, respectively. The recording medium P is conveyed between these parts by the delivery cylinders 80, 90 and 100.

The delivery cylinders 80, 90 and 100 include delivery cylinder main bodies 81, 91 and 101 constituted by frame bodies, and the grippers G provided with the deliver cylinder main bodies 81, 91 and 101. The delivery cylinder bodies 81, 91 and 101 are formed in accordance with the width of the recording medium and driven to rotate by a motor, not shown (in the clockwise direction in FIG. 1). Consequently, the grippers G are rotated on the same circumference. The recording medium P is held at its tip end part by the grippers G and conveyed. In this embodiment, the grippers G are disposed in a pair symmetrically with the rotational axis therebetween, so as to be able to convey two recording media per rotation of the conveyance drums.

Arc-shaped guide plates 83, 93 and 103 are arranged in lower parts of the delivery cylinders 80, 90 and 100 respectively, along the conveyance path of the recording medium P. The recording medium P is conveyed by the delivery cylinders 80, 90 and 100 while having its rear surface (the side rear of the recording surface) guided by the guide plates 83, 93 and 103.

Dryers 84, 94 and 104 for blowing hot air toward the recording medium P conveyed by the delivery cylinders 80, 90 and 100 are disposed inside the delivery cylinders 80, 90 and 100, respectively. The recording surface of the recording medium P conveyed by the delivery cylinders 80, 90 and 100 is applied with the hot air blown by the dryers 84, 94 and 104 during a step of conveying the recording medium.

The recording medium P fed from the sheet feeding part 20 is delivered to the conveyance drum 31 of the treatment liquid application part 30 and then delivered from the conveyance drum 31 of the treatment liquid application part 30 to the conveyance drum 41 of the image recording part 40 via the delivery cylinder 80. The recording medium P is then delivered from the conveyance drum 41 of the image recording part 40 to the conveyance drum 51 of the dryer 50 via the delivery cylinder 90 and then delivered from the conveyance drum 51 of the ink dryer 50 to the conveyance drum 61 of the fixing part 60 via the delivery cylinder 100. The recording medium P is then delivered from the conveyance drum 61 of the fixing part 60 to the recovery part 70. In this series of conveyance step, the recording medium P is subjected to required processing, whereby an image is formed on the recording surface.

The recording medium P is conveyed to the conveyance drum 31, 41, 51 and 61, with the recording surface thereof facing the outside, and is conveyed to the delivery cylinders 80, 90 and 100, with the recording surface facing the inside.

The configurations of the components of the inkjet recording apparatus 10 according to the present embodiment are described hereinafter in detail.

Sheet Feeding Part

The sheet feeding part 20 has a sheet feeding apparatus 21, a sheet feeding tray 22, and a delivery cylinder 23, to continuously feed sheets of recording media P, one by one, to the treatment liquid application part 30.

The sheet feeding apparatus 21 feeds the recording media P stacked on a magazine, not shown, to the sheet feeding tray 22 one by one, from the top, in sequence.

The sheet feeding tray 22 sends the recording media P, fed from the sheet feeding apparatus 21, to the delivery cylinder 23.

The delivery cylinder 23 receives the recording media P from the sheet feeding tray 22, conveys the recording media P along the conveyance path, and delivers the recording media P to the conveyance drum 31 of the treatment liquid application part 30.

General-purpose recording media which are not inkjet recording media, are used as the recording media P.

Treatment Liquid Application Part

The treatment liquid application part 30 applies a predetermined treatment liquid to the recording surface of the recording medium P. The treatment liquid application part 30 includes the conveyance drum 31 for conveying the recording medium P (referred to as "treatment liquid application drum" hereinafter), and a treatment liquid application apparatus 32 for applying the predetermined treatment liquid to the recording surface of the recording medium P conveyed by the treatment liquid application drum 31.

The treatment liquid application drum 31 receives the recording medium P (receives the recording medium P while holding the tip end of the recording medium P using a gripper G) from the delivery cylinder 23 of the sheet feeding part 20 and conveys the recording medium P by rotating.

The treatment liquid application apparatus 32 applies the treatment liquid functioning to aggregate the color materials of the ink, to the recording surface of the recording medium P conveyed by the treatment liquid application drum 31. The treatment liquid application apparatus 32 is configured by, for example, a coating apparatus for applying the treatment liquid using a roller, wherein a coating roller having a circumferential surface thereof coated with the treatment liquid is brought into pressure abutment with the surface of the recording medium P, so as to apply the treatment liquid to the recording surface of the recording medium P. Applying the treatment liquid beforehand and depositing the ink can prevent the occurrence of feathering or bleeding and allow high-quality recording to be performed even when a general-purpose recording medium is used. The treatment liquid application apparatus 32 can also adopting a configuration using inkjet heads described below or liquid droplet ejection heads similar thereto to apply the treatment liquid, and a configuration where the treatment liquid is applied by spraying.

According to the treatment liquid application part 30 having the configurations described above, the recording medium P is conveyed through the predetermined conveyance path by the treatment liquid application drum 31 and has the recording surface applied with the treatment liquid by the treatment liquid application apparatus 32 during the conveyance step. The recording medium P having the recording surface applied with the treatment liquid is then delivered from the treatment liquid application drum 31 to the delivery cylinder 80 at a predetermined position.

As described above, the delivery cylinder 80 is installed with the dryer 84 therein to blow hot air to the guide plate 83. During the process of conveying the recording medium P from the treatment liquid application part 30 to the image recording part 40 by using the delivery cylinder 80, the hot air is blown onto the recording surface so that the treatment liquid applied thereto is dried (the solvent components of the treatment liquid are evaporated and removed).

Image Recording Part

The image recording part 40 deposits the ink droplets of C, M, Y and K colors onto the recording surface of the recording medium P to render a color image on the recording surface of the recording medium P. The image recording part 40 includes the conveyance drum 41 for conveying the recording medium P (referred to as "image recording drum" hereinafter), the recording medium pressing roller 42 that is pressed against the recording surface of the recording medium P conveyed by the image recording drum 41 so as to stick the rear surface of the recording medium P to the circumferential surface of the image recording drum 41, the recording medium lift detection apparatus 300 for detecting a lift of the recording medium P passing through the recording medium pressing roller 42, and the inkjet heads 44C, 44M, 44Y and 44K for ejecting the ink droplets of C, M, Y and K colors onto the recording medium P.

The image recording drum 41 receives the recording medium P from the delivery cylinder 80 and conveys the recording medium P by rotating. In so doing, as described above, the recording medium P is suctioned and held on the outer circumferential surface of the image recording drum 41 and conveyed. Therefore, an arc-shaped surface defined by the outer circumferential surface of the image recording drum 41 (the region ranging from a place where the recording medium P is received from the delivery cylinder 80 to a place where the recording medium P is delivered to the delivery cylinder 90) is used as the conveyance surface, and the recording medium P is conveyed through the conveyance path which is set on the conveyance surface. Note that the conveyance path is set so as to pass through the middle of the image recording drum 41 and correspond to the width of the recording medium P.

The recording medium pressing roller 42 is installed in the vicinity of a recording medium receiving position of the image recording drum 41 (a position where the recording medium P is received from the delivery cylinder 80). The recording medium pressing roller 42 is applied with pressing force by a pressing mechanism, not shown, and thereby comes into pressure contact with the circumferential surface of the image recording drum 41. The recording medium P that is delivered from the delivery cylinder 80 to the image recording drum 41 is nipped by passing through the recording medium pressing roller 42, whereby the rear surface of the recording medium sticks to the outer circumferential surface of the image recording drum 41.

The four inkjet heads 44C, 44M, 44Y and 44K are disposed, after the recording medium lift detection apparatus 300, along the conveyance path of the recording medium P at a constant interval. The inkjet heads 44C, 44M, 44Y and 44K are configured by line heads corresponding to the width of the recording medium, and cause ink droplets of the respective colors to be ejected from nozzle rows formed on nozzle surfaces of these inkjet heads toward the image recording drum 41.

According to the image recording part 40 having the configurations described above, the recording medium P is conveyed through the predetermined conveyance path by the image recording drum 41. The recording medium P that is delivered from the delivery cylinder 80 to the image recording drum 41 is, first, nipped by the recording medium pressing roller 42 to stick to the outer circumferential surface of the image recording drum 41. Next, whether the recording medium P is lifted or not is detected by the recording medium lift detection apparatus 300. Subsequently, the ink droplets of C, M, Y and K colors are deposited from the inkjet heads 44C, 44M, 44Y and 44K onto the recording surface, whereby a color image is rendered on the recording surface.

In the inkjet recording apparatus 10 of the present embodiment, water-based ink having thermoplastic resin dispersed in the ink is used each of the colors. Even with the water-based ink, high-quality recording can be accomplished without causing feathering and bleeding since the predetermined treatment liquid is applied to the recording medium P as described above.

The recording medium P having the image rendered thereon is delivered to the delivery cylinder 90, conveyed through the predetermined conveyance path by the delivery cylinder 90, and delivered to the conveyance drum 51 of the ink dryer 50. As described above, the delivery cylinder 90 is installed with the dryer 94 therein to blow hot air to the guide plate 93. An ink drying process is performed by the ink dryer 50 disposed at a later processing stage, but the recording medium P is also subjected to a drying process while being conveyed by the delivery cylinder 90.

Although not illustrated in FIG. 1, the image recording part 40 has a maintenance part for performing maintenance on the inkjet heads 44C, 44M, 44Y and 44K, wherein the inkjet heads 44C, 44M, 44Y and 44K can be moved to the maintenance part, according to need, and subjected to required maintenance.

Ink Dryer

The ink dryer 50 dries liquid components remaining on the recording medium P after the image is recorded thereon. The ink dryer 50 includes the conveyance drum 51 for conveying the recording medium P (referred to as "ink drying drum" hereinafter), and an ink drying apparatus 52 for performing the drying process on the recording medium P conveyed by the ink drying drum 51.

The ink drying drum 51 receives the recording medium P from the delivery cylinder 90 and conveys the recording medium P by rotating.

The ink drying apparatus 52 is configured by, for example, a dryer (in the present embodiment, three dryers arranged along the conveyance path of the recording medium P). The ink on the recording medium P is dried by hot air blown toward the recording medium P conveyed by the ink drying drum 51 (the liquid components on the recording medium are evaporated).

According to the ink dryer 50 having the configurations described above, the recording medium P is conveyed by the ink drying drum 51. Then, during the course of conveying the recording medium P, the ink drying apparatus 52 blows the hot air onto the recording surface, so that the ink applied to the recording surface is dried.

After passing through the ink drying apparatus 52, the recording medium P is delivered from the ink drying drum 51 to the delivery cylinder 100 at a predetermined position. The recording medium P is then conveyed through the predetermined conveyance path by the delivery cylinder 100 and delivered to the conveyance drum 61 of the fixing part 60.

As described above, the delivery cylinder 100 has the dryer 104 installed therein to blow hot air toward the guide plate 103. Therefore, the recording medium P is also subjected the drying process while being conveyed by the delivery cylinder 100.

Fixing Part

The fixing part 60 applies heat and pressure to the recording medium P to fix the image recorded on the recording surface. The fixing part 60 includes the conveyance drum 61 for conveying the recording medium P (referred to as "fixing drum" hereinafter), heat rollers 62 and 63 for performing a heating/pressurizing process on the recording medium P conveyed by the fixing drum 61, and an inline sensor 64 for detecting the temperature, humidity and the like of the recording medium P after the image is recorded thereon, and capturing the recorded image.

The fixing drum 61 receives the recording medium P from the delivery cylinder 100 and conveys the recording medium P by rotating.

The heat rollers 62 and 63 apply heat and pressure to the ink applied to the recording surface of the recording medium P, so as to adhere (weld) the thermoplastic resin dispersed in the ink to form an ink film. Simultaneously, the heat rollers 62 and 63 also correct a deformation, such as cockling and curling, of the recording medium P. Each of the heat rollers 62 and 63 has substantially the same width as the fixing drum 61 and is heated to a predetermined temperature by a built-in heater. Each of the heat rollers 62 and 63 is brought into pressure contact with a circumferential surface of the fixing drum 61 by a pressurizing device, not shown, at predetermined pressing force. The recording medium P is heated and pressured by the heat rollers 62 and 63 during passing through the heat rollers 62 and 63.

The inline sensor 64 has a thermometer, a hygrometer, a CCD line sensor and the like, to not only detect the temperature and humidity of the recording medium P conveyed by the fixing drum 61 but also capture the image recorded on the recording medium P. Abnormality of the apparatuses, poor ejection of the heads and the like are checked based on the results of detection performed by the inline sensor 64.

According to the fixing part 60 having the configurations described above, the recording medium P is conveyed by the fixing drum 61, and the heat rollers 62 and 63 come into pressure contact with the recording surface during the course of conveying the recording medium P, to apply heat and pressure to the recording medium P. As a result, the thermoplastic resin that is dispersed in the ink is adhered, forming the ink film. At the same time, the deformation of the recording medium P is corrected.

After this fixation process, the recording medium P is delivered from the fixing drum 61 to the recovery part 70 at a predetermined position.

Recovery Part

The recovery part 70 stacks the recording medium P on the stacker 71 after the series of recording processes, to collect the recording medium P. The recovery part 70 includes the stacker 71 for recovering the recording medium P, and a sheet ejection conveyor 72 that receives the recording medium P subjected to the fixation process by the fixing part 60, from the fixing drum 61, conveys the recording medium P through the predetermined conveyance path, and ejects the recording medium P to the stacker 71.

After being subjected to the fixation process by the fixing part 60, the recording medium P is delivered from the fixing drum 61 to the sheet ejection conveyor 72, conveyed to the stacker 71 by the sheet ejection conveyor 72, and recovered into the stacker 71.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A recording medium lift detection apparatus for detecting a lift of a recording medium that is conveyed on a predetermined conveyance surface along a predetermined conveyance path, the recording medium lift detection apparatus comprising:

a light projection/receiving device which has a light projection unit for emitting a detection beam and a light receiving unit for receiving the detection beam, the light projection unit and the light receiving unit being disposed so as to face each other across the conveyance path;

a light projection parallel flat plate, installed on an optical path of the detection beam between the light projection unit and the conveyance path, for causing parallel shift of the optical path of the detection beam;

a light projection turning device for turning the light projection parallel flat plate;

a control device for controlling the light projection turning device; and a recording medium lift detection control device that monitors an amount of light received by the light receiving unit, and stops conveying the recording medium or outputs an alarm when the amount of light received by the light receiving unit is equal to or lower than a predetermined value, wherein:

the light projection/receiving device is installed in such a manner that the detection beam is positioned at a predetermined height above the conveyance surface, the light projection parallel flat plate has a beam entrance surface and a beam emission surface parallel to each other, and is configured to turn about a rotational axis perpendicular to the detection beam, so as to refract the detection beam having entered from the beam entrance surface to cause the parallel shift of the optical path of the detection beam in a direction away from the conveyance surface and emit the detection beam from the beam emission surface, the light projection turning device is connected to the rotational axis of the light projection parallel flat plate, and the control device controls the light projection turning device at predetermined timing so as to turn the light projection parallel flat plate to cause the parallel shift of the detection beam in the direction away from the conveyance surface.

2. The recording medium lift detection apparatus as defined in claim 1, further comprising:

a light reception parallel flat plate, installed on the optical path of the detection beam between the conveyance path and the light receiving unit, for causing parallel shift of the optical path of the detection beam;

a light reception turning device for turning the light reception parallel flat plate; and a light reception aperture that is a stop installed on the optical path of the detection beam between the light reception parallel flat plate and the light receiving unit, wherein:

the light reception parallel flat plate has a beam entrance surface and a beam emission surface parallel to each other, and is configured to turn about a rotational axis perpendicular to the detection beam, so as to refract the detection beam having entered from the beam entrance surface to cause the parallel shift of the optical path of the detection beam in a direction to get close to the conveyance surface and emit the detection beam from the beam emission surface, the light reception turning device is connected to the rotational axis of the light reception parallel flat plate, and the control device controls the light projection turning device and the light reception turning device at predetermined timing in such a manner that the light projection parallel flat plate is turned so as cause the parallel shift of the detection beam in the direction away from the conveyance surface and the light reception parallel flat plate is turned so as to cause the parallel shift of the optical path of the detection beam in the direction to get close to the conveyance surface.

3. The recording medium lift detection apparatus as defined in claim 2, further comprising a light projection aperture that is a stop installed on the optical path of the detection beam, between the light projection unit and the light projection parallel flat plate.

4. An inkjet recording apparatus comprising:

a conveyance device for conveying a recording medium;

an inkjet head for depositing ink droplets onto a recording surface of the recording medium conveyed by the conveyance device so as to render an image on the recording surface; and the recording medium lift detection apparatus as defined in claim 1 which is installed on an upstream side of the inkjet head and detects the recording medium lifted off the conveyance surface of the conveyance device.

5. The inkjet recording apparatus as defined in claim 4, wherein:

the conveyance device is a cylindrical drum that rotates while holding the recording medium on an outer circumferential surface forming the conveyance surface of the conveyance device, so as to convey the recording medium, the inkjet recording apparatus further comprises:

a cylindrical recording medium pressing roller that is positioned on an upstream side of the light projection/receiving device and presses the recording medium against the conveyance surface; and at least one recessed part formed on the outer circumferential surface of the drum, and when the at least one recessed part is brought below the recording medium pressing roller by rotation of the drum, the control device controls the light projection turning device in such a manner that the light projection parallel flat plate is turned so as to cause the parallel shift of the detection beam in the direction away from the conveyance surface.

* * * * *